US011359478B2

(12) United States Patent
Baskin

(10) Patent No.: US 11,359,478 B2
(45) Date of Patent: Jun. 14, 2022

(54) LUBRICATION SYSTEM FOR A PLUNGER/PACKING SET OF A FLUID END

(71) Applicant: CS&P Technologies LP, Cypress, TX (US)

(72) Inventor: Kennis Baskin, Cypress, TX (US)

( * ) Notice: Subject to any disclaimer, the term of this patent is extended or adjusted under 35 U.S.C. 154(b) by 551 days.

(21) Appl. No.: 16/534,163

(22) Filed: Aug. 7, 2019

(65) Prior Publication Data

US 2021/0040836 A1 Feb. 11, 2021

(51) Int. Cl.

| | |
|---|---|
| ***E21B 4/00*** | (2006.01) |
| ***E21B 4/16*** | (2006.01) |
| ***E21B 44/06*** | (2006.01) |
| ***E21B 47/06*** | (2012.01) |

(52) U.S. Cl.

CPC ..... *E21B 44/06* (2013.01); *E21B 4/003* (2013.01); *E21B 4/16* (2013.01); *E21B 47/06* (2013.01)

(58) Field of Classification Search

CPC . E21B 4/003; E21B 4/16; E21B 44/06; E21B 47/06

See application file for complete search history.

(56) References Cited

U.S. PATENT DOCUMENTS

| | | | | |
|---|---|---|---|---|
| 3,785,659 A | | 1/1974 | Maurer | |
| 5,209,495 A | * | 5/1993 | Palmour | F04B 53/164 277/926 |
| 8,621,979 B2 | * | 1/2014 | Brunet | F16C 33/1045 166/308.1 |
| 8,998,593 B2 | | 4/2015 | Vicars | |
| 10,280,725 B2 | | 5/2019 | Jiang | |
| 10,436,766 B1 | * | 10/2019 | Bayyouk | F04B 53/18 |
| 2005/0200081 A1 | | 9/2005 | Stanton | |
| 2011/0239856 A1 | * | 10/2011 | Tiller | F04B 53/18 92/153 |
| 2016/0177945 A1 | * | 6/2016 | Byrne | F04B 53/18 184/6 |
| 2016/0178123 A1 | | 6/2016 | Beaver | |
| 2020/0347990 A1 | * | 11/2020 | McKim | F16N 25/00 |

FOREIGN PATENT DOCUMENTS

WO 2019046680 A1 3/2019

* cited by examiner

*Primary Examiner* — Matthew R Buck

(74) *Attorney, Agent, or Firm* — Egbert, McDaniel & Swartz, PLLC

(57) ABSTRACT

A lubrication system for a plunger/packing set of a fluid end has a lubricating fluid reservoir, a pump cooperative with the lubricating fluid reservoir so as to pump a lubricating fluid from the lubricating fluid reservoir toward the plunger/packing set, a primary pressure transducer cooperative with the pump so as to measure a pressure of the lubricating fluid exiting the fluid pump, a secondary pressure transducer cooperative with the fluid end so as to measure a pressure of the lubricating fluid exiting the plunger/packing set, and a controller connected to the second pressure transducer so as to obtain a representation of the pressure measured by the secondary pressure transducer.

20 Claims, 3 Drawing Sheets

LUBRICATION SYSTEM FOR A PLUNGER/PACKING SET OF A FLUID END

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

Field of the Invention

The present invention relates to fluid ends as used in fracturing operations. More particularly, the present invention relates to the delivery of a lubricating fluid to the packing and reciprocating plunger within the fluid end. More particularly, the present invention relates to the measurement and collection of data of pressures of the lubricating fluid passing to and from plunger/packing sets of the fluid ends.

Description of Related Art Including Information Disclosed Under 37 CFR 1.97 and 37 CFR 1.98

Hydraulic fracturing is the injection, under pressure, of water, sand, and/or other fluids within a well formation to induce fractures in a rock layer. Oil and gas drilling operators commonly use hydraulic fracturing (or "fracking") to release petroleum and natural gas well as other substances from the rock layer. The high pressure injection creates new channels in the rock which can increase the extraction rates and ultimate recovery of fossil fuels. A hydraulic fracturing pump or "frac pump" is used to pump water, sand, gravel, acids, proprietary liquids and concrete into the well formation. The solids pumped down the hole into the fractures keep the fractures from closing after the pressure is released. Operators generally attempt to pump as much volume as possible at or above the pressure necessary to fracture the well.

Fracturing gas or oil wells is very expensive and is generally charged by the hour. Because the formation may be located thousands of feet below the earth's surface, the pressures generated and required by fracturing pumps are substantial, sometimes exceeding 20,000 pounds per square inch (p.s.i.). At peak times, a given fracturing pump may operate for more than eight consecutive hours (with drive engines running) at as much as 2800 revolutions per minute (rpm). With gear changes, the pump generally runs between a low of 60 rpm to a high of as much as 300 rpm.

A fracturing pump comprises two major components: a power frame and a fluid end. The power frame and fluid end are held together by a group of stay rods. The power frame is driven by high horsepower diesel engines, electric motors, or turbine engines. Internally, a fracturing pump increases pressure within a fluid cylinder by reciprocating a plunger longitudinally within the fluid end cylinder. Conventional high pressure, high volume fracturing pumps have either three or five cylinders. Other designs may have more or fewer cylinders.

The fluid ends of hydraulic or well stimulation pumps must produce enormous pressure and move a large volume of an abrasive fluid that is high in solids content. Fracturing pumps were originally designed for intermittent service of six to eight hours per day. Today's pumps operate many more hours per day and require much more maintenance than ever before.

A conventional fluid end comprises a block of steel comprising a plunger opening and compression area, intake and pressure valves with an intake path for supply of media to the plunger area and an exit path, internally connected to the compression chamber, for the pressurized fluid transfer. The vast majority of conventional fluid ends are "mono blocks". A mono block is machined from a single piece of material weighing approximately 4500-8000 lbs. Recently, segmented fluid ends have been introduced in which the block is divided into a number of pieces corresponding to the number of cylinders. For example, a three cylinder fluid end ("triplex") in such a conventional segmented fluid end comprises three segments and a five cylinder fluid end "quint" comprises five segments. Each segment of such segmented fluid ends comprises a single block of material. The design and maintenance of the conventional one piece segmented fluid end is virtually no different than the design or maintenance of the conventional mono block.

FIG. 1 shows one type of fluid end assembly 1 that includes a plurality of individual fluid end segments that are joined in side-by-side relationship. A suction manifold 4 is located at the bottom of the individual fluid end segments 2. A discharge manifold 6 is in fluid communication with a fluid end segments 2 and extends across a top of the fluid end segments 2. Pressure transducer/relief valve ports 8 are cooperative with the common discharge manifold 6. A service rail 9 is configured so as to support the fluid end assembly 1 at an exterior surface. The fluid end segments 2 in the fluid end assembly 1 are not joined together. The intake manifold 4 and the discharge manifold 6 go into and out of each of the segments 2. The user hooks the flowlines to each end of the manifolds 4 and 6 instead of to the end of the fluid end and suction manifold as is the case with a conventional mono block 2. This fluid end assembly 1 succeeded in making block failure modular.

One of the challenges facing operators of fluids ends in general, is the need to lubricate the packing and reciprocating plunger (the "plunger/packing set") within each of the fluid ends. It is essential in the operation of such fluid ends that the reciprocating plunger and packing are fully lubricated. As such, in the past, operators have pumped lubricating fluid at pressures of between 4000 and 5000 p.s.i. This strong pressure of lubricating fluid flow assures that there is a proper lubrication of the packing and reciprocating plunger. However, this amount of lubricating fluid creates a large amount of excess which flows out of a fluid end. The excess lubricating fluid will eventually flow into a grease pan. This excess lubricating fluid will need to be disposed and new lubricating fluid introduced into the lubricating system. The disposal of the lubricating fluid adds additional labor requirements and costs. The large amount of lubricating fluid used for the lubrication of the fluid end also adds costs to the lubrication system. This process of providing excess lubricating fluid to the plunger/packing set of fluid end will provide no feedback to the operator of problems occurring within the fluid end, such as the deterioration of the reciprocating plunger or deterioration of the packing associated with the fluid end. As such, a need has developed so as to reduce the amount of lubricating fluid used in the lubrication system and also a need has developed for providing feedback as to the condition of the internal components of the fluid end.

In the prior art, there is a system known as an automatic lubrication system. This automatic lubrication system is a "time out" system that operates at very high pressures. The control panel of this system allows the user to set a run time during which the pump forces grease into the packing. The user also sets a resting period at the end of the run time, during which no grease is pumped. At the end of the resting, the pump then performs another cycle of the set run time and set rest time. It is a trial-and-error system whereby periodic visual inspection of the fluid end and plungers is used to detect whether excess of lubrication is occurring. This is indicated by the volume of lubricating fluid pumped out of or being forced out around the plunger. It is a passive or non-real-time assessment and is not viewable during the fracturing operation. As a consequence of this configuration, it is a very high pressure system and creates a bias toward excessive lubricating fluid and consequent excessive used lubricating fluid disposal. This system uses individual lubrication lines directly from the lubrication fluid reservoir to the fluid end. When packing replacement or other events occur that require purging of air, auxiliary high-pressure grease pumping equipment is required to be connected to fittings serving each line. Each line is individually purged. This additional purging equipment is required and mechanic time is required for each line.

Another existing automatic system is also a time-out system operating at high pressures. In this system, however, a pressure sensor set to 1400 p.s.i. sets the run time. Once a pressure of 1400 p.s.i. is detected, the grease pump times out for a user-specified period of time. After the time-out is complete, the system resumes until 1400 p.s.i. is again detected. As above, the pressure level is well in excess of the necessary lubrication fluid pressure rates. The time-out at this pressure does provide some relief of unneeded lubrication fluid flow and waste. As above, lubrication fluid assessment occurs between the fracturing operations when the fluid end and the fracturing truck can be safely approached and visually inspected. There is one unit for each plunger in the fluid end. As such, three units are required for a triplex pump. Purging is carried out with additional equipment required to purge one line at a time.

In the past, various patents have issued relating to lubrication systems for fracturing pumps and fluid ends. For example, U.S. Pat. No. 3,785,659 issued on Jan. 15, 1974 to Maurer et al., teaches a packing cartridge for a reciprocating pump which includes a sleeve adapted to be connected to a recessed end of the fluid end housing and a packing assembly mounted in the sleeve. A lubricating port formed in the sleeve extends from an exposed end thereof to the interior of the sleeve and provides a means for delivering lubricant to the packing assembly.

U.S. Pat. No. 8,621,979, issued on Jan. 7, 2014 to Brunet et al., describes a lubricating system for a reciprocating apparatus. A positive displacement pump includes a lubricating manifold having a first fluid pathway, a housing having a second fluid pathway in fluid communication with the first fluid pathway, a crosshead slide within the housing and having a third fluid pathway in fluid communication with the second fluid pathway, and a crosshead configured to reciprocate within the crosshead slide. The crosshead has a fourth fluid pathway in fluid communication with the third pathway. The crosshead further includes a wrist-pin having a fluid pathway in fluid communication with the fourth fluid pathway. A crankshaft is located within the housing. A connecting rod is disposed between the crosshead and the crankshaft and is connected thereto.

U.S. Pat. No. 8,998,593, issued on Apr. 7, 2015 to B. L. Vicars, teaches a fluid end assembly having a pump housing with a number of interior passages for the flow of fluids. The housing has a plunger bore with a closed inner end and an open outer end. A suction passage intersects the plunger bore. A discharge passage intersects both the plunger bore and the suction passage such that the discharge passage, the suction passage and the plunger bore radiate outwardly from their point of intersection to define a Y-shape. A connector passage branches from the discharge passage. An outlet passage intersects the connector passage and passes through the pump housing at right angles to the plunger bore. A reciprocating plunger is located in the plunger bore. A suction valve is located in the suction passage. A discharge valve is located in the discharge passage. A fluid supply manifold is pivotally secured to the housing and is in fluid communication with the suction passage.

U.S. Pat. No. 10,280,725, issued on May 7, 2019 to J. Jiang, describes a hydraulic double-acting fracturing pump skid having a skid chassis, power motors, oil pumps, a hydraulic power end and fluid ends. The power motors and the oil pumps are arranged at two ends of the skid chassis. The hydraulic power end is arranged in the middle of the skid chassis. The fluid ends are arranged on two sides of the hydraulic power end. The power motors are connected to the oil pumps via a transmission mechanism. The oil pumps communicate with the hydraulic power end via a three-position four-way directional valve and can drive the hydraulic power end to operate.

U.S. Patent Application Publication No. 2005/0200081, published on Sep. 15, 2005 to Stanton et al., shows a packing cartridge provided for use in the maintenance of a packing bore for a plunger-type pump. The packing cartridge includes a generally cylindrical sleeve adapted to be at least partially positioned in the packing bore, a first abutment ring positioned in the sleeve, and a second abutment ring positioned in the sleeve and co-axially spaced apart from the first abutment ring. Telescoping structures are operatively positioned between the first abutment ring and the second abutment ring.

U.S. Patent Application Publication No. 2011/0239856, published on Oct. 6, 2011 to Tiller et al., provides a plunger pump lubrication system and method. The system includes a pressure-regulated lubricant discharge from the packing gland. The pressure regulated lubricant discharge maintains a positive pressure in the packing gland to resist unloading of the packing.

U.S. Patent Application Publication No. 2016/0178123, published on Jun. 23, 2016 to Beaver et al., shows a machine fluid containment trough. This trough includes a frame having a first end, a second end, and a trough between the first and second ends. A mass of extendable fabric is positioned proximate to the first end of the frame and configured to be drawn across the trough to the second and. A holder secures a portion of the fabric proximate to the first end. The fabric can include a carrying structure, such as a roll. The holder can also include a rod to receive and secure the carrying roll.

U.S. Patent Application Publication No. 2016/0177945, published on Jun. 23, 2016 to Byrne et al., discloses a reciprocating pump with a dual circuit power end lubrication system. This dual circuit lubrication system is for the power end of a reciprocating pump. The dual circuit lubrication system includes a lubrication pump that supplies lubrication fluid to a high-pressure lubrication circuit and a low-pressure lubrication circuit. The high-pressure lubrication circuit is fluidly coupled to a crankshaft to supply lubrication fluid to sliding surfaces associated with the crankshaft and a first lubrication fluid pressure. The crankshaft drives a crosshead coupled to a plunger to displace fluid from a fluid end of the reciprocating pump. The low-pressure lubrication circuit is fluidly coupled to supply the lubrication fluid to a plurality of rolling surfaces associated with the crankshaft at a second lubrication fluid pressure. The first lubrication fluid pressure is greater than the second lubrication fluid pressure.

International Publication No. WO 2019/046680, published on Mar. 7, 2019 to J. Bayyouk, shows a lubrication system for a fracturing pump. The lubrication system includes a lubrication system housing, a lubrication tank held by the lubrication system housing, a heating device held by the lubrication system housing, a cooling device held by the lubrication system housing, and a filtration device held by the lubrication system housing. The lubrication system housing is configured to be mounted to the fracturing pump housing or held within the fracturing pump housing.

It is an object of the present invention to provide a lubrication that reduces the amount of lubrication fluid used in the lubrication of the plunger and/or packing fluid end.

It is another object of the present invention to provide a lubrication system that minimizes lubrication fluid disposal.

It is another object of the present invention to provide a lubrication system that decreases purging time and the expenses associated therewith.

It is another object of the present invention to provide a lubrication system that provides real-time assessment of lubrication metrics.

It is a further object the present invention to provide a lubrication system that allows for the early detection of packing failure, the need for packing adjustment, or other conditions of the fluid and/or fracturing pump that would require attention.

It is still another object of the present invention to provide a lubrication system which allows servicing to occur in advance of failure of the fluid end.

These and other objects and advantages of the present invention will become apparent from a reading of the attached specification and appended claims.

BRIEF SUMMARY OF THE INVENTION

The present invention is a lubrication system that comprises a fluid end having a plunger/packing set therein, a lubricating fluid reservoir, a pump cooperative with the lubricating fluid reservoir so as to pump a lubricating fluid from the lubricating fluid reservoir toward the plunger/packing set, a primary pressure transducer cooperative with the pump so as to measure a pressure of the lubricating fluid exiting the pump and before the lubricating fluid inlet of the fluid end, a secondary pressure transducer cooperative with the fluid end so as to measure a pressure of the lubricating fluid exiting the plunger/packing set, and a controller connected to the secondary pressure transducer so as to obtain a representation of the pressure of the lubricating fluid measured by the secondary pressure transducer.

In the present invention, the fluid end comprises a plurality of fluid ends or a plurality of plunger/packing sets within a fluid end. The lubricating system further includes a manifold connected by a conduit to the pump. The manifold receives the lubricating fluid therein from the conduit. A plurality of lines extend from the manifold to each of the plunger/packing sets. The secondary pressure transducer comprises a plurality of secondary pressure transducers cooperative with the fluid pressure of the lubricating fluid exiting the plurality of plunger/packing sets. The plurality of secondary pressure transducers are connected to the controller.

A plurality of check valves are mounted on the plurality of lines extending from the manifold. The plurality of check valves prevent a flow of the lubricating fluid toward the manifold. The plurality of secondary pressure transducers have, respectively, a plurality of conduits extending from the plurality of fluid ends or the plunger/packing sets. Each of the plurality of conduits has a bleed valve thereon.

A collection tray is positioned downstream of the fluid end. The collection tray is adapted to receive the lubricating fluid after exiting the fluid end or the plunger/packing sets.

A relief valve is connected to the conduit in a location downstream of the primary pressure transducer. The relief valve limits a pressure of the lubricating fluid passing to the fluid end. In particular, in the preferred embodiment, the relief valve limits the fluid pressure to no more than 100 p.s.i. Excess lubrication fluid released by the relief valve returns to the reservoir.

The controller monitors the fluid pressure of the secondary pressure transducers and monitors the fluid pressure of the primary pressure transducer. A two speed motor is connected to the pump so as to drive the pump selectively at either a first speed or a second speed. One speed is used for driving the lubricating fluid from the reservoir to the plunger/packing set of the fluid end. The other speed is for the purging of the fluid end. A fill line is connected to the reservoir. The fill line is adapted to add lubricating fluid to the interior of the reservoir. A data cable is connected to the controller. The data cable is adapted to transmit data from the controller to a remote location.

The present invention is also a process for lubricating a plunger/packing set of a fluid end. This process includes the steps of: (1) flowing the lubricating fluid from a reservoir to the plunger/packing set of the fluid end; (2) measuring a pressure of the lubricating fluid as the lubricating fluid flows from the reservoir to the plunger/packing set of the fluid end; (3) lubricating the plunger/packing set in the fluid end with a portion of the lubricating fluid; (4) measuring a pressure of the lubricating fluid that passes outward of the plunger/packing set; and (5) determining a condition of the plunger/packing set within the fluid end based on the measured pressure.

In the process of the present invention, the pressure of the lubricating fluid flowing to the plunger/packing set end is no more than 100 p.s.i. The step of flowing the lubricating fluid includes flowing the lubricating fluid from the reservoir into a manifold. In particular, when the fluid end has a plurality of plunger/packing sets, the step of flowing includes flowing the lubricating fluid from the manifold through a plurality of lines to the plurality of plunger/packing sets. The step of lubricating includes lubricating the plurality of plunger/packing sets. The step of measuring the pressure of the remainder of the lubricating fluid includes measuring the fluid pressure of the remainder of the lubricating fluid from each of the plurality of plunger/packing sets. The step of determining includes measuring fluid pressure of the remainder of the lubricating fluid from each of the plurality of plunger/packing sets so as to monitor fluid pressure in each of the plurality of plunger/packing sets.

The process of the present invention further includes the steps of collecting the remainder of the lubricating fluid downstream of the measurement of the fluid pressure.

The lubrication system of the present invention utilizes a single unit to service the plunger/packing sets of fluid ends. The system pumps lubricating fluid in normal operation at 100 p.s.i. which supplies all of the lubrication requirements. While the packing is healthy, the fluid end will not accept lubricating fluid at more than 100 p.s.i. The pump pumps the lubricating fluid to a manifold which is attached to a primary pressure transducer, a relief valve, and sufficient flow line connections for the number of plunger/packing sets in the fluid end to be serviced. Since the plunger/packing set does not need more than 100 p.s.i. of lubricating fluid, the pressure relief valve relieves at 100 p.s.i. and allows such excess lubricating fluid to flow and return back to the reservoir. The primary pressure transducer supplies data to the controller. A data cable can be installed from a frac-truck located control unit to a secondary monitoring unit which can be located in the frac data trailer with other real-time monitoring equipment.

The lubricating fluid that is accepted flows beyond the relief valve through the individual flow line connections toward the plunger/packing sets. The lubricating fluid flows through each flow line and first passes a check valve and then flows into the individual lower grease ports on the bottom of the fluid end for each plunger/packing set. A bleed valve and secondary pressure transducer are attached to the upper grease port. The secondary pressure transducer reads and supplies the lubricating fluid pressure detected for each plunger/packing set. This data is then supplied to the control unit. This data can also be supplied to a data cable to a secondary monitoring unit located with other real-time monitoring equipment. This equipment assesses the progression of the fracturing or other well servicing operation in progress. Parameters are set within the controller and the remote monitoring units so as to cause the display of flashing warning lights and providing readouts of pressure available to a field team.

The two-speed motor is used with the pump. The utilization of the manifold in conjunction with a two-speed motor provides for variable pump flow and allow simultaneous purging of all lines without additional equipment.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
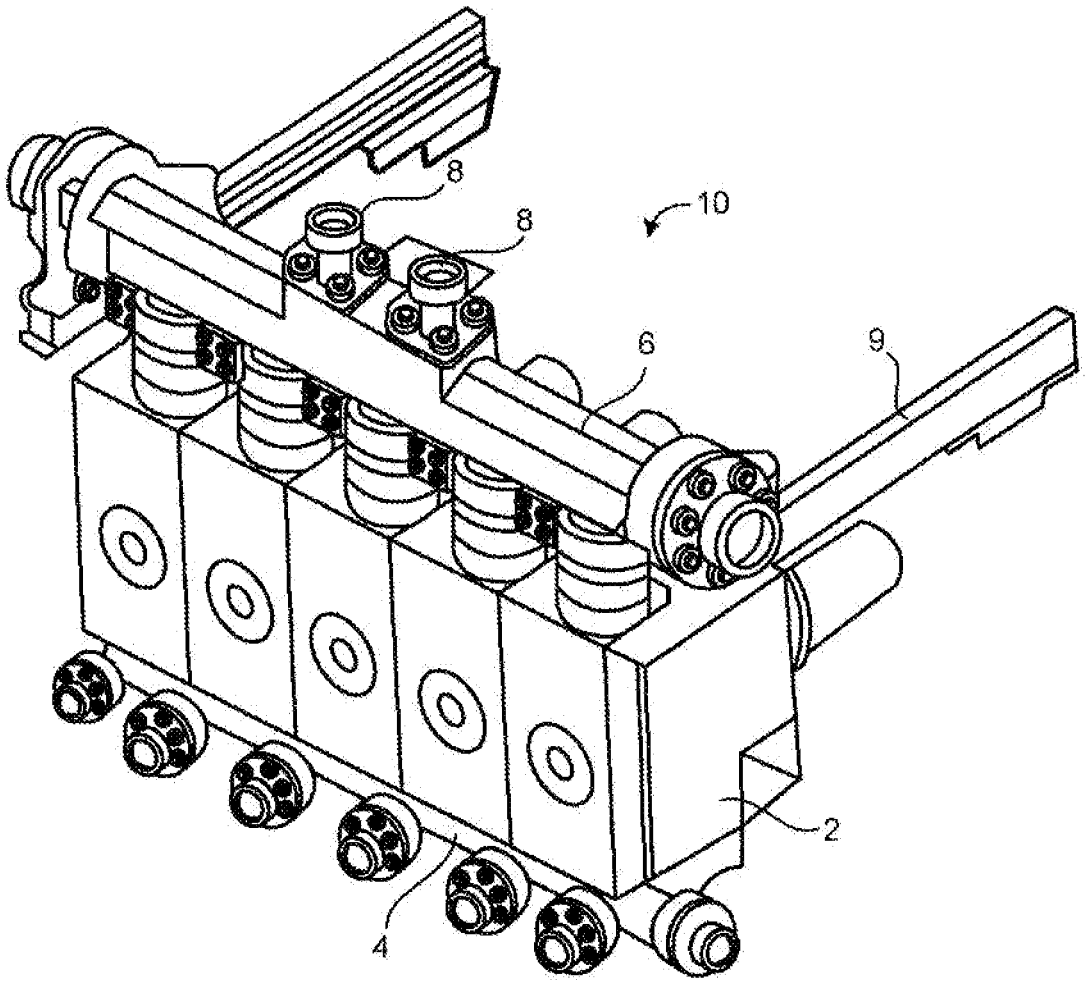
FIG. 1 PRIOR ART
FIG. 1 is a perspective view of a prior art fluid end assembly.
Figure 2:
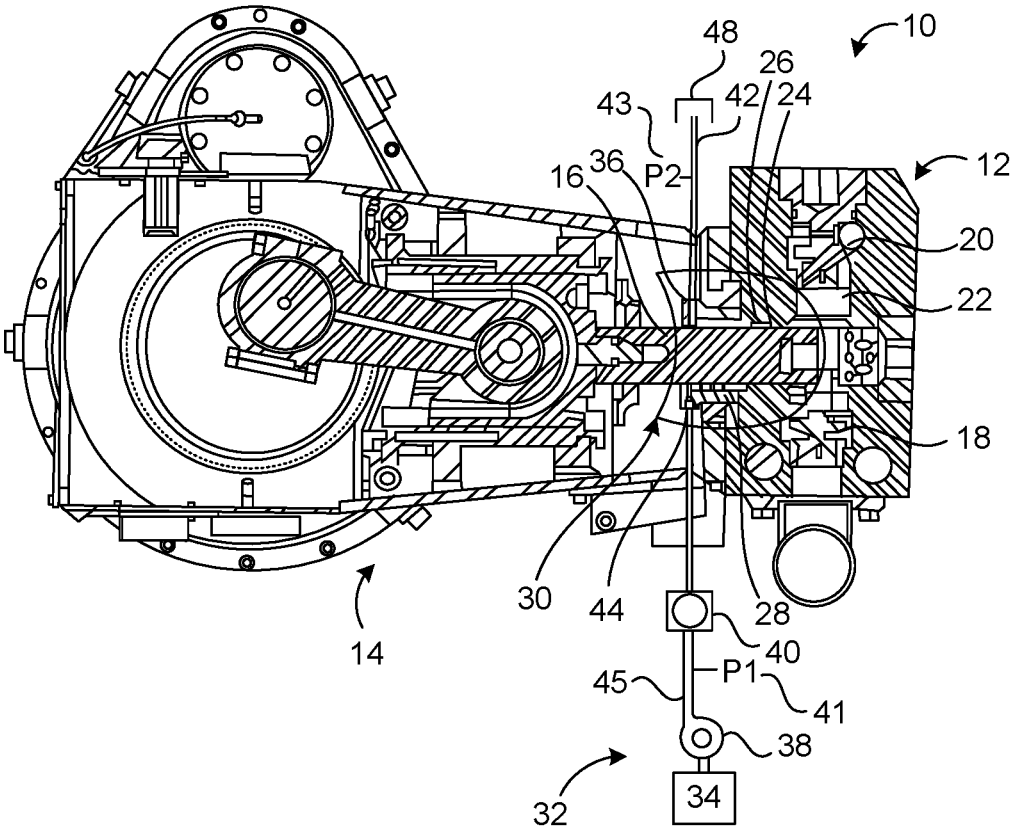
FIG. 2 is a cross-sectional view showing a reciprocating pump and fluid end assembly employing the lubrication system of the present invention.

Referring to FIG. 2 is a cut-away view that schematically illustrates a plunger pump 10. The plunger pump 10 can be a well service pump and includes a fluid end 12, a power end 14 and a plunger 16. Fluid end 12 has a suction valve 18 and a discharge valve 20 in fluid communication through a first bore 22. A cylinder 24 intersects the first bore 22 and has a port 26. A packing 28 includes a packing gland 30 disposed at port 26. Plunger 16 reciprocates through the packing 28 and the packing gland 30.

The plunger pump 10 has the lubrication system 32 fluidically connected to the packing gland 30. FIG. 2 schematically illustrates the lubrication system 32 having the lubricant 34 (e.g. oil, grease) connected through an inlet port 36 to the packing gland 30. The lubricant 34 is provided under pressure by way of pump 38. The lubricant passes through a check valve 40 to the packing gland 30. Lubrication system 32 further includes a discharge line 42 connected to the packing gland 30 through a discharge port 44. A primary pressure transducer 41 detects fluid pressure in the fluid conduit between the pump 38 and the check valve 40. A secondary pressure transducer 43 detects pressure of the lubricating fluid passing through the discharge line 42. A collection tray 48 is located at the end of the discharge line 42 so as to receive excess lubricant from discharge line 42.

In normal use of the system shown in FIG. 2, the primary pressure transducer 41 measures the pressure of the lubricating fluid passing from the pump 38 to the check valve 40. The check valve 40 prevents the return of lubricating fluid. As will be described hereinafter, the conduit 45 extending from the pump 38 to the plunger 16 and the packing 28 will flow the lubricating fluid to a manifold and then pass to each of the plunger/packing sets within the fluid end. This is shown fully in FIG. 3. The secondary pressure transducer 43 will measure the pressure of the lubricating fluid passing through the discharge line 42. In normal use, a portion of the lubricating fluid will be received by the packing 28 and the plunger 16. The remainder of the lubricating fluid will flow outwardly through the discharge line 42 and into the collection tray 48. A change of the pressure measured by the secondary pressure transducer 43 can be indicative of damage or misalignment of the plunger/packing set. As such, this can be indicative of the need for repair. Ultimately, since the pressure regulator maintains the fluid pressure of the fluid passing through the conduit 45 at 100 p.s.i. or less, and since the secondary pressure transducer 43 measures the pressure of the discharged lubricating fluid, assessments can be properly made as to the conditions of the plunger/packing set within the fluid end 12. For example, if the plunger/packing set refuses to accept the 100 p.s.i. fluid pressure, then this can be indicative of the obstructions in the plunger/packing set. If the pressure sensed by the secondary pressure transducer 43 senses a great difference in pressure between the pressure sensed by the first pressure transducer 41 and the second pressure transducer 43 is beyond expected parameters or varies greatly, then this can be indicative of process pressure and onset of packing or other internal failings.

Figure 3:
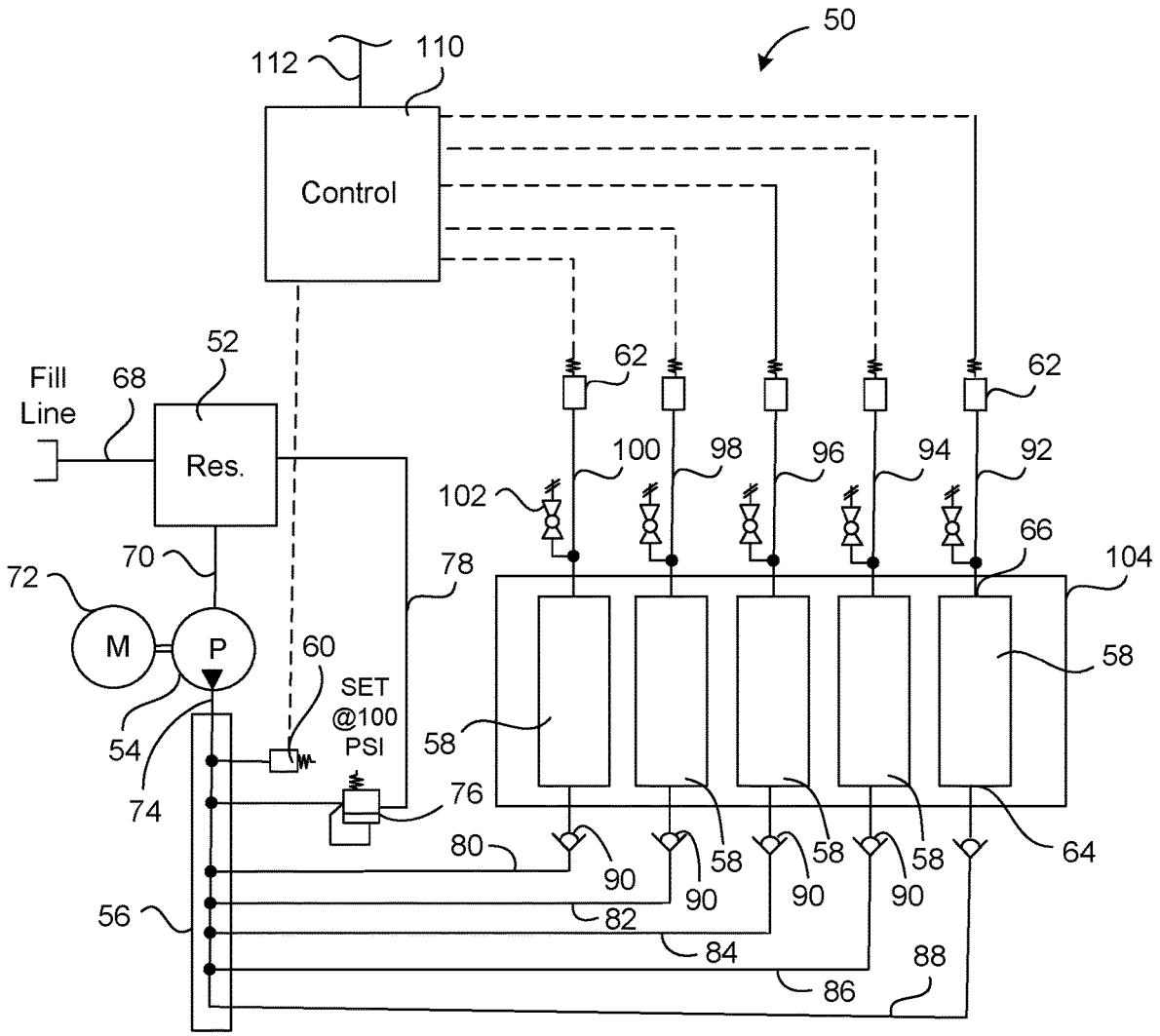
FIG. 3 is a diagrammatic illustration of the lubrication system of the present invention.

FIG. 3 is a diagrammatic illustration of the lubricating system 50 of the present invention. This lubricating system 50 includes a reservoir 52, a pump 54, a manifold 56, a plurality of plunger/packing sets 58, a first pressure transducer 60 and a plurality of secondary pressure transducers 62.

Each of the plurality of fluids 58 includes at least one plunger/packing set (as shown in FIG. 2). Each of the fluid ends 58 includes a lubricating fluid inlet 64 and a lubricating fluid outlet 66. The lubricating fluid will pass through the fluid ends 58 so as to properly lubricate the plunger/packing set therein.

The lubricating fluid reservoir 52 has a supply of lubricating fluid, such as grease, therein. A fill line 68 extends to the lubricating fluid reservoir 52 so as to supply additional lubricating fluid to the interior of the reservoir 52, when required. The pump 54 is cooperative with the lubricating fluid reservoir 52. A two speed motor 72 is operatively connected to the pump 54 so as to operate the pump 54 at a first speed or a second speed. One speed is adapted to deliver lubricating fluid from the reservoir 52 to the plurality of plunger/packing sets of the fluid end 58. The other speed is used for the purging of the plunger/packing sets of fluid end 58 and the lines associated therewith. The pump 54 is adapted to deliver the lubricating fluid, under pressure, to the plurality of plunger/packing set of the fluid end 58.

The primary pressure transducer 60 is cooperative with a conduit 74 that extends from the pump 54. The primary pressure transducer 60 measures the pressure of the lubricating fluid exiting the pump 54 prior to entering the lubricating fluid inlet 64 of the fluid end 58. A pressure regulator/relief valve 76 is also connected to the conduit 64. The pressure regulator/relief valve 76 serves to fix the pressure of the lubricating fluid in the conduit 64 to no more than 100 p.s.i. The pressure regulator/relief valve 76 can deliver excess lubricating fluid along line 78 back to the lubricating fluid reservoir 52.

The conduit 74 is connected to the manifold 56. Manifold 56 allows the lubricating fluid to be delivered along lines 80, 82, 84, 86 and 88 to the plurality of plunger/packing sets fluid end 58. Check valves 90 are positioned on each of the lines 80, 82, 84, 86 and 88 so as to prevent the return flow of lubricating fluid from the plurality of plunger/packing sets of fluid end 58.

The lubricating fluid will pass through the interior of the plurality of fluid end 58 so as to lubricate the plunger/packing set therein. The remaining lubricating fluid will pass outwardly through the lubricating fluid outlet 66 of the plunger/packing set. It will then flow through conduits 92, 94, 96, 98 and 100 to the plurality of secondary pressure transducers 62. Separate secondary pressure transducers 62 are cooperative with the lubricating fluid in each of the conduits 92, 94, 96, 98 and 100 so as to separately measure the pressure of the lubricating fluid therein. Bleed valves 102 are provided on each of the pipes 92, 94, 96, 98 and 100 so as to selectively allow for purging.

Ultimately, any lubricating fluid escaping the system will be received within a collection tray 104.

Importantly, in the present invention, a controller 110 is connected to each of the plurality of secondary pressure transducers 62 and to the primary pressure transducer 60. As such, the pressures measured by the primary pressure transducer 60 and the secondary pressure transducer 62 can be received by the controller 110. A data cable 112 can be connected to the controller 110 so as to deliver this information to a remote location, such as monitoring equipment on a frac truck.

In the present invention, if there is a change of pressure noted amongst the various secondary pressure transducers 62, attention can be directed toward the particular plunger/packing set associated with that pressure transducer. As such, as these changes are noted, repairs can be made or assessments can be made as to the particular fluid end. The notation of such changes can provide a great deal of benefit to operators in order to avoid a premature failure or destruction of the fluid end. Additionally, by limiting the lubricating fluid provided to the plurality of plunger/packing sets, the amount of lubricating fluid consumed by the lubricating system 50 of the present invention can be minimized. There is no need to flow excess lubricating fluid in order to effectively lubricate the system. The amount of lubricating fluid delivered is maintained at a very constant pressure and at an optimal volume.

Lubricating system 50 of the present invention utilizes a single unit to service the plunger/packing sets of various fluid ends. The system pumps lubricating fluid, in normal operation, at 100 p.s.i. which the supplies all of the lubrication required. While the packing is healthy, a fluid end will not accept lubricating fluid at more than 100 p.s.i. The pump 54 pumps lubricating to the manifold 56 attached thereto which is attached the primary pressure transducer 60, the relief valve 76 and the flow line connections for the number of plungers in the fluid end to be serviced. Since the packing does not require more than 100 p.s.i. of lubrication, the pressure relief valve 76 relieves at 100 p.s.i. and allows this excess lubrication fluid to flow and returned to the lubricating fluid reservoir 52. The primary pressure transducer 60 supplies data to the controller 110. The data cable 112 can be installed from the frac truck located control unit to a secondary monitoring unit which can be located in the frac data trailer with other real-time monitoring equipment.

The lubricating fluid that is accepted flows beyond the relief valve 60 through the individual flow line connections 80, 82, 84, 86 and 88 toward the plunger/packing set. The lubricating fluid flowing through each of the flow lines 80, 82, 84, 86 and 88 first passes the check valve 90 and then flows into the individual lower lubrication fluid ports on the bottom of the plunger/packing set. A bleed valve 102 and secondary pressure transducer 62 are attached to the upper lubricating fluid outlet 66 for each of the plunger/packing sets of the fluid ends. The secondary pressure transducer 62 reads and supplies the lubricating fluid pressure detected for each plunger/packing set. This information is then transmitted to the controller 110. The data cable 112 can deliver this information to a secondary monitoring unit located with other real-time monitoring equipment so as to assess the progression of the fracturing or other well servicing operation in progress. Parameters are set within the controller 110 and the remote monitoring units so as to trigger warnings and to provide readouts of pressures available to the field team.

The two speed motor 72 and the pump 54 in conjunction with the manifold provides for variable pump flow and allows for simultaneous purging of all lines without additional equipment.

The lubrication system 50 of the present invention lowers lubrication fluid usage to the amount actually required. This reduces expense and reduces the cost of used lubrication fluid disposal by as much as 50%. The lubrication system 50 lowers purging time and the expense associated therewith. The lubrication system 50 provides a new and safe real-time assessment of lubrication metrics. This allows earlier detection ofpacking failure, the need for packing adjustment, or other conditions of the fluid end or frac pump that would warrant attention. The early detection of packing failure or the need for packing adjustment will allow the fluid ends to be serviced in advance of block damage or failure. As such, the losses associated with block failure can be avoided.

The foregoing disclosure and description of the invention is illustrative and explanatory thereof. Various changes in the details of the illustrated construction and in the steps of the described method can be made within the scope of the present invention without departing from the true spirit of the invention. The present invention should only be limited by the following claims and their legal equivalents.

I claim:

1. A lubrication system comprising:

a fluid end having a plunger/packing set therein;

a lubricating fluid reservoir;

a pump cooperative with said lubricating fluid reservoir so as to pump a lubricating fluid from said lubricating fluid reservoir toward said plunger/packing set, said fluid end having a lubricating fluid inlet and a lubricating fluid outlet;

a primary pressure transducer cooperative with said pump so as to measure a pressure of the lubricating fluid exiting said pump and before the lubricating fluid inlet of said fluid end;

a secondary pressure transducer cooperative with said fluid end so as to measure a pressure of the lubricating fluid exiting said plunger/packing set; and a controller connected to said secondary pressure transducer so as to obtain a representation of the pressure of the lubricating fluid measured by said secondary pressure transducer.

2. The lubrication system of claim 1, said fluid end comprising a plurality of plunger/packing sets, the lubrication system further comprising:

a manifold connected by a conduit to said pump, said manifold receiving the lubricating fluid therein; and a plurality of lines extending from said manifold to each of said plurality of plunger/packing sets.

3. The lubrication system of claim 2, said secondary pressure transducer comprising:

a plurality of secondary pressure transducers cooperative with the lubricating fluid exiting said plurality of plunger/packing sets, said plurality of secondary pressure transducers being connected to said controller.

4. The lubrication system of claim 2, further comprising:

a plurality of check valves mounted on said plurality of lines extending from said manifold, said plurality of check valves preventing a flow of lubricating fluid toward said, manifold.

5. The lubrication system of claim 3, said plurality of secondary pressure transducers having respectively a plurality of conduits extending from said plurality of plunger/packing set, each of said plurality of conduits having a bleed valve thereon.

6. The lubrication system of claim 1, further comprising:

a collection tray position downstream of said fluid end, said collection tray adapted to receive the lubricating fluid after exiting said fluid end.

7. The lubrication system of claim 2, further comprising:

a relief valve connected to the conduit in a location downstream of said primary pressure transducer, said relief valve limiting a pressure of the lubricating fluid passing to said fluid end.

8. The lubrication system of claim 7, said relief valve limiting the fluid pressure to no more than 100 p.s.i.

9. The lubrication system of claim 7, said relief valve cooperative with said reservoir so as to return excess pressures of the lubricating fluid back to said reservoir.

10. The lubrication system of claim 3, said controller monitoring the fluid pressure at the plurality of secondary pressure transducers and at the primary pressure transducer.

11. The lubrication system of claim 1, further comprising:

a two speed motor connected to said pump so as to drive said pump selectively at either a first speed or a second speed.

12. The lubrication system of claim 1, further comprising:

a fill line connected to said reservoir, said fill line adapted to add lubrication fluid to an interior of said reservoir.

13. The lubrication of system of claim 1, further comprising:

a data cable connected to said controller, said data cable adapted to transmit data from said controller to a remote location.

14. A process for lubricating a fluid end, the process comprising:

flowing a lubricating fluid from a reservoir to a plunger/packing set of the fluid end;

measuring a pressure of the lubricating fluid as the lubricating fluid flows from the reservoir to the plunger/packing set;

lubricating the plunger/packing set in the fluid end with a portion of the lubricating fluid;

passing a remainder of the lubricating fluid outwardly of the plunger/packing set;

measuring a pressure of the remainder of the lubricating fluid that passes outwardly of the plunger/packing set; and monitoring the measured pressures so as to determine a condition of the plunger/packing set within the fluid end.

15. The process of claim 14, the pressure of the lubricating fluid flowing to the plunger/packing set of the fluid end being no more than 100 p.s.i.

16. The process of claim 14, the step of flowing the lubricating fluid comprising:

flowing the lubricating fluid from the reservoir into a manifold.

17. The process of claim 16, the fluid end having a plurality of plunger/packing sets, the step of flowing further comprising:

flowing the lubricating fluid from the manifold through a plurality of lines to the plurality of plunger/packing sets, the step of lubricating comprising lubricating the plurality of plunger/packing sets.

18. The process of claim 17, the step of measuring the pressure of the remainder of the lubricating fluid comprising:

measuring the fluid pressure of the remainder of the lubricating fluid from each of the plurality of plunger/packing sets.

19. The process of claim 18, the step of monitoring comprising:

monitoring the measured fluid pressure of the remainder of the lubricating fluid from each of the plurality of plunger/packing sets so as to determine differences in fluid pressure between each of the plurality of plunger/packing sets.

20. The process of claim 14, further comprising:

relieving pressure in excess of a desired pressure by returning an excess lubricating fluid back to the reservoir before the lubricating fluid flows to the plunger/packing set.

* * * * *